US008044004B2

(12) United States Patent
Goto et al.

(10) Patent No.: US 8,044,004 B2
(45) **Date of Patent: *Oct. 25, 2011**

(54) METALWORKING OIL COMPOSITION, METALWORKING METHOD AND METALWORK

(75) Inventors: Koichi Goto, Fujisawa (JP); Kazuyoshi Takeda, Fujisawa (JP); Eiji Niwa, Fujisawa (JP)

(73) Assignee: Kyodo Yushi Co., Ltd., Fujisawa-Shi, Kanagawa (JP)

( * ) Notice: Subject to any disclaimer, the term of this patent is extended or adjusted under 35 U.S.C. 154(b) by 167 days.

This patent is subject to a terminal disclaimer.

(21) Appl. No.: 12/306,813

(22) PCT Filed: Jul. 2, 2007

(86) PCT No.: PCT/JP2007/063229

§ 371 (c)(1),
(2), (4) Date: Dec. 29, 2008

(87) PCT Pub. No.: WO2008/001933

PCT Pub. Date: Jan. 3, 2008

(65) Prior Publication Data

US 2009/0298730 A1 Dec. 3, 2009

(30) Foreign Application Priority Data

Jun. 30, 2006 (JP) ..... 2006-181501

(51) Int. Cl.
*C10M 173/00* (2006.01)
*C07F 9/10* (2006.01)

(52) U.S. Cl. ..... 508/308; 508/428

(58) Field of Classification Search ..... 508/308, 508/428

See application file for complete search history.

(56) References Cited

U.S. PATENT DOCUMENTS

| | | | | | |
|---|---|---|---|---|---|
| 2,688,001 | A | | 8/1954 | Echols | |
| 3,773,664 | A | | 11/1973 | Lesuer | |
| 4,105,571 | A | * | 8/1978 | Shaub et al. | 508/237 |
| 4,159,254 | A | | 6/1979 | Grier et al. | |
| 4,479,883 | A | * | 10/1984 | Shaub et al. | 508/364 |
| 4,617,134 | A | * | 10/1986 | Shaub | 508/378 |
| 5,736,493 | A | * | 4/1998 | Garmier | 508/491 |

(Continued)

FOREIGN PATENT DOCUMENTS

EP 0 594 320 4/1994

(Continued)

OTHER PUBLICATIONS

International Search Report for PCT/JP2007/063229, mailed Oct. 7, 2007.

(Continued)

*Primary Examiner* — Ellen M. McAvoy
*Assistant Examiner* — Vishal Vasisth
(74) *Attorney, Agent, or Firm* — Nixon & Vanderhye P.C.

(57) ABSTRACT

The invention provides a metalworking oil composition which is used for a very small amount of oil-feeding type metalworking method, said composition comprising a base oil selected from the group consisting of natural fats and oils, derivatives thereof and synthetic ester oils; and an antirust agent comprising a sorbitan fatty acid ester and a phospholipid, and a metalworking method using the composition and metalwork obtained by the metalworking method. The oil composition shows excellent lubricity and antirust property and is suitably used for metalworking of metallic materials such as cast iron, steel, stainless steel, and nonferrous metal (such as Al alloy and Mg alloy) by a method in which a very small amount of oil is supplied.

9 Claims, 1 Drawing Sheet

U.S. PATENT DOCUMENTS

| | | | | |
|---|---|---|---|---|
| 5,858,933 | A * | 1/1999 | Nikoloff | 508/428 |
| 5,990,055 | A | 11/1999 | Garmier | |
| 2002/0035043 | A1 | 3/2002 | Yokota et al. | |
| 2003/0162671 | A1* | 8/2003 | Kalota et al. | 508/154 |
| 2004/0053791 | A1* | 3/2004 | Langer et al. | 508/154 |
| 2004/0116309 | A1 | 6/2004 | Yokota et al. | |
| 2005/0197260 | A1* | 9/2005 | Johnson et al. | 508/216 |

FOREIGN PATENT DOCUMENTS

| | | |
|---|---|---|
| JP | 09-057537 | 3/1997 |
| JP | 2000-219890 | 8/2000 |
| JP | 2000-248289 | 9/2000 |
| JP | 2000-256688 | 9/2000 |
| JP | 2001-239437 | 9/2001 |
| JP | 2001-354984 | 12/2001 |
| JP | 2004-204214 | 7/2004 |
| JP | 2004-300317 | 10/2004 |
| WO | WO 01/30945 | 5/2001 |
| WO | WO 02/081605 | 10/2002 |

OTHER PUBLICATIONS

Written Opinion of the International Searching Authority for PCT/JP2007/063229, mailed Oct. 2, 2007.

Gunstone, et al., "Lipid Technologies and Applications," Chapter 3: Phospholipids, Dekker, New York, US, Jan. 1, 1997, XP009135311, ISBN: 978-0-8247-9838-3, pp. 51-78.

European Search Report for corresponding European Patent Application No. 07768004.9-2104, dated Feb. 16, 2011.

* cited by examiner

METALWORKING OIL COMPOSITION, METALWORKING METHOD AND METALWORK

This application is a 371 of PCT/JP2007/063229, filed Jul. 2, 2007.

TECHNICAL FIELD

The present invention relates to a metalworking oil composition, and more particularly to a metalworking oil composition which is used for a very small amount of oil-feeding type metalworking method and which is widely applicable to metalworkings such as cutting, grinding, component rolling, press working and plastic working. The present invention further relates to a metalworking method and metalworks obtained by the metalworking method.

BACKGROUND ART

In cutting and grinding processes, oils for cutting and grinding are generally used. Most important functions required for oils for cutting and grinding are lubricating and cooling actions, which can extend the life of the tool used for the processing, improve the finished surface precision of the worked products, raise production efficiency and increase productivity. In conventional cutting and grinding processes, a relatively larger amount of cutting and grinding oils are supplied to points to be processed. However, recently, as interest in environmental problems grow, there are pointed out problems such as waste, environmental sanitation, and energy conservation to oils for cutting and grinding which are effective for production efficiency. In recent years, studies are underway on dry processes for cutting process, grinding process and the like as environmentally friendly methods for metalworking processes. When cutting and grinding processes are conducted in a dry condition, the above environmental problems are reduced but it is not possible to obtain performance such as lubricity and cooling property which are required for oils for cutting and grinding.

It is therefore necessary to cool the processing point, for example, by spraying compressed cooling air or the like. However, since a completely dry process lacks lubricity between processing tool and a material to be processed, a very small amount of lubricating oil is supplied. Examples of working methods include a processing method for nonferrous metal (for example, see Patent Document 1). If conventionally known metalworking oil compositions (for example, see Patent Document 2) is used for processing ferrous material, such problems occur that dew condensation water is formed to generate rust. Therefore, it is not possible to apply these oil compositions to cooling air processing or mist cutting processing. There has been proposed a metalworking oil composition having high antirust property (for example, see Patent Document 3). There has also been proposed a metalworking oil composition comprising phosphatidyl choline compound (for example, see Patent Document 4). As for these metalworking oils, a new working oil which is capable of further improving workability, extending the life span of the instrument and reducing the amount of oil to be supplied is desired in view of increasing the productivity and/or saving energy.

Patent Document 1 JP-A-2001-239437
Patent Document 2 JP-A-2000-256688
Patent Document 3 JP-A-2004-300317
Patent Document 4 JP-A-09-57537

DISCLOSURE OF THE INVENTION

Problems to be Solved by the Invention

An object of the present invention is to provide a metalworking oil composition which is suitable for metalworking of metallic materials such as cast iron, steel, stainless steel, and nonferrous metal (such as Al alloy and Mg alloy), in particular, for metalworking method in which a very small amount of oil is supplied.

Another object of the present invention is to provide a metalworking oil composition which has good lubricating properties and antirust properties when it is used for metalworking of metallic materials such as cast iron, steel, stainless steel, and nonferrous metal (such as Al alloy and Mg alloy).

Further object of the present invention is to provide a metalworking method of metallic materials such as cast iron, steel, stainless steel, and nonferrous metal (such as Al alloy and Mg alloy) and metalworks.

Means for Solving the Problems

In order to attain the above-mentioned objects, the present inventors intensively studied to discover that an oil composition comprising a base oil selected from the group consisting of natural fats and oils, derivatives thereof and ester oils, and sorbitan oleate and a phospholipid has good lubricating properties and antirust properties and is suitable for the very small amount of oil-feeding type metalworking of metallic materials such as cast iron, steel, stainless steel and nonferrous metals, thereby completing the present invention.

The present invention provides the following metalworking oil composition, metalworking method and metalworks.

1. A metalworking oil composition which is used for a very small amount of oil-feeding type metalworking method, said composition comprising a sorbitan fatty acid ester and a phospholipid.
2. A metalworking oil composition which is used for a very small amount of oil-feeding type metalworking method, said composition comprising (I) a base oil selected from the group consisting of natural fats and oils, derivatives thereof and synthetic ester oils; and (II) an antirust agent comprising a sorbitan fatty acid ester and a phospholipid.
3. The metalworking oil composition of the above item 1 or 2, wherein the sorbitan fatty acid ester comprises at least one selected from the group consisting of sorbitan monooleate, sorbitan sesquioleate, sorbitan dioleate and sorbitan trioleate.
4. The metalworking oil composition of any one of the above items 1 to 3, wherein the phospholipid comprises at least one selected from the group consisting of egg-yolk lecithin, soybean lecithin and the like.
5. The metalworking oil composition of any one of the above items 1 to 4, wherein the phospholipid comprises a mixture of phosphatidyl choline, phosphatidyl ethanolamine and phosphatidyl inositol.
6. The metalworking oil composition of any one of the above items 1 to 5, wherein said composition contains said sorbitan fatty acid ester in an amount of 0.1 to 40% by mass.
7. The metalworking oil composition of any one of the above items 1 to 6, wherein said composition contains said phospholipid in an amount of 0.1 to 40% by mass.
8. The metalworking oil composition of any one of the above items 1 to 7, wherein the very small amount of oil-feeding type metalworking method is a method by which metallic materials are processed while supplying, by a compressed fluid, water drops whose surface is covered with an oil film.

9. The metalworking oil composition of any one of the above items 1 to 7, wherein the very small amount of oil-feeding metalworking method is a method by which metallic materials are processed while transforming the metalworking oil into a form of mist and supplying the mist by a compressed fluid.
10. A very small amount of oil-feeding type metalworking method, comprising processing a metallic material using the metalworking oil composition of any one of the above items 1 to 9.
11. The metalworking method of the above item 10, wherein metallic materials are processed while supplying, by a compressed fluid, water drops covered with the metalworking oil composition of any one of the above items 1 to 9.
12. The metalworking method of the above item 10, wherein metallic materials are processed while transforming the metalworking oil composition of any one of the above items 1 to 9 into a form of mist and supplying the mist by a compressed fluid.
13. A metalwork obtained by the metalworking method of any one of the above items 10 to 12.

EFFECTS OF THE INVENTION

By the metalworking oil composition of the present invention and by the metalworking method, cutting, grinding, component rolling, press working, plastic working and the like of metallic materials may be performed efficiently. Further, an economical and low environmental load process may be carried out because the amount of the oil used is very small. The metalwork obtained by the metalworking process of the present invention has good accuracy of finishing.

BEST MODES FOR CARRYING OUT THE INVENTION

The present invention will now be described in detail.

The present invention relates to a metalworking oil composition which is used for the very small amount of oil-feeding type metalworking method, the composition being characterized by comprising a sorbitan fatty acid ester and a phospholipid. Moreover, the present invention relates to a working oil composition comprising (I) a base oil selected from the group consisting of natural fats and oils, derivatives thereof and synthetic ester oils; and (II) an antirust agent comprising a sorbitan fatty acid ester and a phospholipid.

The base oil used in the oil composition of the present invention is selected from the group consisting of natural fats and oils, derivatives thereof and synthetic ester oils.

Examples of the natural fats and oils include rapeseed oil, soybean oil, castor oil, palm oil, lard and the like. Examples of the derivatives of natural fats and oils include hydrogenated products such as hydrogenated rapeseed oil, hydrogenated soybean oil, hydrogenated castor oil, hydrogenated palm oil, hydrogenated lard and the like; and alkylene oxide-added castor oil and the like. Examples of synthetic ester oils include ester series synthetic oils typified by polyol esters.

The base oil of the present invention may also include a naphthene series or paraffin series mineral oil; synthetic hydrocarbon oil typified by poly alpha-olefin, polybutene; ether series synthetic oil typified by alkyl diphenyl ether and polypropylene glycol; silicon oil; fluorinated oil and the like. It should be noted, however, that the principle component of the base oil of the present invention is selected from the group consisting of natural fats and oils, derivatives thereof and synthetic ester oils, and that these components account for at least 70% by mass, preferably at least 80% by mass, more preferably at least 90% by mass. Ester oils are most preferable from the viewpoint of lubricating properties and adsorptive properties to the newly generated surface. The ester oil has a polar group in the molecule thereof, and therefore the ester oil constitutes an adsorption film which has good lubricating properties on the metal surface.

Examples of fatty acid components of the sorbitan fatty acid esters used in the oil composition of the present invention include preferably saturated or unsaturated fatty acids having 8-22 carbon atoms, more preferably saturated or unsaturated fatty acids having 16-20 carbon atoms, and most preferably unsaturated fatty acids having 16-20 carbon atoms.

Most preferred examples of the sorbitan fatty acid esters include sorbitan oleates and more specifically sorbitan monooleate, sorbitan sesquioleate, sorbitan trioleate, with sorbitan monooleate and sorbitan sesquioleate being particularly preferred.

The sorbitan fatty acid esters used in the oil composition of the present invention are commercially available. For example, there are commercially available products: sorbitan monooleate such as Trade names: Nonion SO-80R (NOF Corporation), BLAUNON P-80 (Aoki Oil Industrial Co., Ltd.), Sorbon S-80 (TOHO Chemical Industry Co., Ltd.), Ionet S-80 (Sanyo Chemical Industries, Ltd.), RHEODOL SP-O10 (KAO Corporation); sorbitan sesquioleate such as Trade names: Nonion OP-83RAT (NOF Corporation), Sorbon S-83L (TOHO Chemical Industry Co., Ltd.), RHEODOL AO-15 (KAO Corporation); and sorbitan trioleate such as Trade names: Nonion OP-85R(NOF Corporation), Ionet S-85 (Sanyo Chemical Industries, Ltd.), RHEODOL SP-030 (LAO Corporation), Sorbon S-85 (TOHO Chemical Industry Co., Ltd.) and the like.

The amount of the sorbitan fatty acid esters used in the oil composition of the present invention is preferably 0.1-40% by mass, more preferably 0.2-20% by mass, most preferably 0.5-10% by mass based on the total mass of the composition. If the amount is less than the lower limit, it becomes difficult to obtain expected lubricating and antirust properties, while if it is more than the higher limit, effects are saturated, viscosity and antifoaming property may get worse and uneconomical.

Examples of the phospholipids used in the metalworking oil composition of the present invention include egg-yolk lecithin, soybean lecithin and the like. Egg-yolk lecithin, and soybean lecithin are commercially available in the form of powder which is highly purified and in the form of liquid which is poorly purified. The commonly called lecithin refers to those in the paste form. This lecithin is a mixture of phospholipids such as phosphatidyl choline, phosphatidyl ethanolamine, phosphatidyl inositol and the like and triglyceride (mainly soy-bean oil).

The phospholipids used in the metalworking oil composition of the present invention may be in any forms. Since the phospholipids in paste form are easy to dissolve in the base oil, they are suitable for producing the oil composition. Phospholipids are commercially available and the commercially available products may be used in the present invention. Examples of such commercially available products include Trade names J lecithin CL (Ajinomoto Co., Inc), Lecithin DX (Nisshin Oil Mills, Ltd.) and the like.

The amount of phospholipids in the metalworking oil composition of the present invention is preferably 0.1 to 40% by mass, more preferably 0.2 to 20% by mass, and most preferably 0.5 to 10% by mass based on the total mass of the composition. If the amount of phospholipids is less than the lower limit, it becomes difficult to obtain expected lubricating and antirust properties, while if it is more than the higher limit, effects are saturated, viscosity may get worse and uneconomical.

The metalworking oil composition of the present invention may include conventional additives widely used in metalworking oil compositions such as load-bearing additives, anticorrosives, metal deactivators and antioxidants as required. The amount of the additives is preferably 10% by mass or less based on the total mass of the oil composition.

The metalworking oil composition of the present invention may easily be produced by adding specific amounts of sorbitan fatty acid esters, for example, sorbitan oleate, phospholipids and optionally other components to the base oil.

As a preferred mode of feeding a very small amount of metalworking oil composition in the very small amount of oil-feeding type metalworking method for carrying out the above-described method according to the present invention, the following methods are preferable:

1. A method of supplying, by a compressed fluid (e.g., air), water drops whose surface is covered with the metalworking oil composition.
2. A method of supplying, by a compressed fluid (e.g., air), a mixed mist of water and the metalworking oil composition.
3. A method of transforming water and the metalworking oil composition into the form of mists in separate systems and supplying, by a compressed fluid (e.g., air), the mists at the same location.
4. A method of transforming the metalworking oil composition into the form of a mist and supplying, by a compressed fluid (e.g., air), the mist.

The method 1 is most preferred. The method of the present invention will now be described in detail by way of the method 1, but the method of the present invention is not restricted thereto. Examples of feeding apparatus for carrying out the method 1 include those disclosed in JP-A-2001-239437. The schematic structure of one example of the feeding apparatus is shown in FIG. 1. Mist consisting of particles which are water drops on whose surface an oil film is formed is produced in such an apparatus by utilizing the same principle as the principle used by a usual spray. At this time, an oil film is efficiently formed on the surface of water drops by inhaling oil on the site near the inlet of air and inhaling water on the site near the outlet.

Examples of methods of processing metallic materials while feeding the metalworking oil composition of the present invention include cutting, grinding, shearing, end milling, component rolling, press working, plastic working and the like. Examples of metallic materials include cast iron, steel, stainless steel, nonferrous metals (such as Al alloy and Mg alloy) and the like.

The amount of the metalworking oil composition of the present invention used is as small as 0.5 to 20 mL, preferably 1 to 10 mL per one nozzle per hour. Therefore, the environmental load is low and it is economically advantageous. The amount of water used is 500 to 2000 mL, preferably 800 to 1500 mL, and for example, 1000 mL per one nozzle per hour. The water used may be tap water or industrial water. The amount of air supplied is suitably about 25 to 250 L, preferably about 50 to 100 L per minute.

Further, in the processing method of the present invention, it is desirable that the low environmental load metalworking oil composition of the present invention be used in a very small amount for a single-use. By doing so, there may also be mitigated or overcome problems in the conventional processes in which water-soluble cutting oil is used, namely, decomposition of diluted water-soluble cutting oil, deterioration of processing solution, such as separation due to an increase in hardness or the like, reduced processing performance due to the above decomposition and/or deterioration, environmental load of waste fluid of diluted water-soluble cutting oil.

The present invention will now be described in more detail by way of examples. However, the present invention is not restricted to the following examples. The modified examples which do not depart from the spirit of the present invention are also included in the scope of the present invention.

EXAMPLES

Metalworking oil compositions according to the formulations shown in Tables 1 to 6 were prepared, then cutting tests were performed while supplying the compositions under the conditions shown below, followed by evaluation of the cutting performance.

The oil composition of Comparative Example 19 is the same as that disclosed in JP-A-2004-300317.

The oil compositions of Examples 1 to 14 and Comparative Example 1 to 26 were supplied by air in the form of water drops whose surface was covered with an oil film. A feed rate of the oil composition was 10 mL/H, that of water 1000 mL/H, and that of air 100 L/H.

In Comparative Example 27, a commercially available emulsion type cutting oil (JIS K2241 A1, No. 1: an emulsion type cutting oil) (5% by mass) was supplied at a discharge pressure of 1 kg/cm$^2$ and a feed rate of 6 L/min.

Evaluation of Cutting Performance

The cutting performance was evaluated by turning operation of carbon steel (S45C). Cutting resistance (N) was perpendicular to feed direction (tool pressing force). If the cutting resistance is lower than that of the oil composition of Comparative Example 19, the oil composition satisfies the standard.

Cutting Conditions

Tools: carbide 6 blades, torsion angle: 45 degree, rake angle: 14 degree, tip: 1R)

Work Material: SKD11 (HRC53) (30×150×200 mm)

Cutting Speed: 300 m/min

Feed: 0.1 mm/blade

Radius Depth of Cut: 0.5 mm

Axial Depth of Cut: 10 mm

Antirust Property

Cast material (FC200) and carbon steel (S45C) were ground with a sandpaper #100 and then with a sandpaper #240 to generate a smooth newly-formed surface. On the newly-formed surface, the oil composition was coated in an amount of 5.0 g/m$^2$, and one drop of tap water was dropped in each of 16 spots by a dropper. After left to stand for 24 hours at room temperature, rust generation was observed.

Criteria for Antirust Property (A, B and C: Pass)

A: Excellent (no rust)

B: Good (rust is observed at 1 to 4 spots)

C: Acceptable (rust is observed at 5 to 8 spots)

D: Unacceptable (rust is observed at 9 to 16 spots)

Tables 1 to 6 show the formulations and evaluation test results of Examples and comparative Examples.

TABLE 1

| (% by mass) | | Ex. 1 | Ex. 2 | Ex. 3 | Ex. 4 | Ex. 5 | Ex. 6 | Ex. 7 |
|---|---|---|---|---|---|---|---|---|
| Phospholipid | | 0.5 | 1.0 | 5.0 | 10.0 | 20.0 | 1.0 | 5.0 |
| Sorbitan monooleate | | 2.0 | 1.0 | 5.0 | 10.0 | 20.0 | | |
| Sorbitan sesquioleate | | | | | | | 1.0 | 5.0 |
| Rapeseed oil | | 97.5 | 98.0 | 90.0 | 80.0 | 60.0 | 98.0 | 90.0 |
| Cutting resistance (N) | | 390 | 390 | 370 | 365 | 360 | 390 | 370 |
| Antirust property | FC200 | A | A | A | A | A | A | A |
| | S45C | A | A | A | A | A | A | A |

TABLE 2

| (% by mass) | Ex. 8 | Ex. 9 | Ex. 10 | Ex. 11 | Ex. 12 | Ex. 13 | Ex. 14 |
|---|---|---|---|---|---|---|---|
| Phospholipid | 10.0 | 20.0 | 1.0 | 5.0 | 10.0 | 20.0 | 0.5 |
| Sorbitan monooleate | | | | | | | 2.0 |
| Sorbitan sesquioleate | 10.0 | 20.0 | | | | | |
| Sorbitan trioleate | | | 1.0 | 5.0 | 10.0 | 20.0 | |
| Mineral oil(ISO46) | | | | | | | 97.5 |

TABLE 2-continued

| (% by mass) | | Ex. 8 | Ex. 9 | Ex. 10 | Ex. 11 | Ex. 12 | Ex. 13 | Ex. 14 |
|---|---|---|---|---|---|---|---|---|
| Rapeseed oil | | 80.0 | 60.0 | 98.0 | 90.0 | 80.0 | 60.0 | |
| Cutting resistance (N) | | 365 | 360 | 390 | 370 | 365 | 360 | 395 |
| Antirust | FC200 | A | A | B | A | A | A | A |
| property | S45C | A | A | A | A | A | A | A |

TABLE 3

| (% by mass) | | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|
| Phospholipid | | | 2.0 | | | | | |
| Sorbitan monooleate | | | | 2.0 | | | | |
| Sorbitan sesquioleate | | | | | 2.0 | | | |
| Sorbitan trioleate | | | | | | 2.0 | | |
| Sorbitan monocaprylate | | | | | | | 2.0 | |
| Sorbitan monolaurate | | | | | | | | 2.0 |
| Rapeseed oil | | 100.0 | 98.0 | 98.0 | 98.0 | 98.0 | 98.0 | 98.0 |
| Cutting resistance (N) | | 420 | 390 | 390 | 390 | 390 | 400 | 395 |
| Antirust | FC200 | D | D | D | D | D | D | D |
| property | S45C | D | A | A | A | A | D | D |

TABLE 4

| (% by mass) | | Comp. Ex. 8 | Comp. Ex. 9 | Comp. Ex. 10 | Comp. Ex. 11 | Comp. Ex. 12 | Comp. Ex. 13 | Comp. Ex. 14 |
|---|---|---|---|---|---|---|---|---|
| Sorbitan monopalmitate | | 2.0 | | | | | | |
| Dicyclohexylamine oleate | | | 2.0 | | | | | |
| Tall oil fatty acid diethanolamine salt | | | | 2.0 | | | | |
| C12 alkenyl succinic anhydride | | | | | 2.0 | | | |
| Ca dinonylnaphthalene sulfonate | | | | | | 2.0 | | |
| Ba dinonylnaphthalene sulfonate | | | | | | | 2.0 | |
| Ethylenediamine dinonylnaphthalene sulfonate | | | | | | | | 2.0 |
| Rapeseed oil | | 98.0 | 98.0 | 98.0 | 98.0 | 98.0 | 98.0 | 98.0 |
| Cutting resistance (N) | | 395 | 415 | 415 | 420 | 420 | 420 | 415 |
| Antirust | FC200 | D | D | D | D | D | D | D |
| property | S45C | D | A | A | B | C | C | C |

TABLE 5

| (% by mass) | | Comp. Ex. 15 | Comp. Ex. 16 | Comp. Ex. 17 | Comp. Ex. 18 | Comp. Ex. 19 | Comp. Ex. 20 |
|---|---|---|---|---|---|---|---|
| Dicyclohexylamine oleate | | | | | | 5.0 | |
| Trimethylolpropane trilanolin fatty acid ester | | 2.0 | | | | | |
| Pentaerythritol dilanolin fatty acid ester | | | 2.0 | | | | |
| Pentaerythritol trilanolin fatty acid ester | | | | 2.0 | | | |
| Tetrapropenyl succinic acid 1,2-propanediol ester | | | | | 2.0 | | |
| 2-Ethylhexyl oleate | | | | | | 10.0 | |
| Mineral oil (ISO46) | | | | | | | 100.0 |
| Rapeseed oil | | 98.0 | 98.0 | 98.0 | 98.0 | 85.0 | |
| Cutting resistance (N) | | 415 | 415 | 415 | 415 | 400 | 450 |
| Antirust | FC200 | D | D | D | D | C | D |
| property | S45C | D | D | D | D | A | D |

TABLE 6

| (% by mass) | | Comp. Ex. 21 | Comp. Ex. 22 | Comp. Ex. 23 | Comp. Ex. 24 | Comp. Ex. 25 | Comp. Ex. 26 | Comp. Ex. 27 |
|---|---|---|---|---|---|---|---|---|
| Phospholipid | | 10.0 | 20.0 | 40.0 | | | | (*) |
| Sorbitan monooleate | | | | | 10.0 | 20.0 | 40.0 | |
| Rapeseed oil | | 90.0 | 80.0 | 60.0 | 90.0 | 80.0 | 60.0 | |
| Cutting resistance (N) | | 375 | 365 | 360 | 370 | 365 | 360 | 440 |
| Antirust property | FC200 | D | D | D | D | D | D | A |
| | S45C | A | A | A | A | A | A | A |

(*): Commercial Product

The results in Tables 1 to 6 show that the oil compositions of Examples 1 to 14 of the present invention which comprises both sorbitan fatty acid ester and phospholipid show low cutting resistances excellent lubricity and excellent antirust property.

In contrast, Comparative Example 1 which does not comprise both sorbitan fatty acid ester and phospholipid show high cutting resistance, and bad antirust property.

Comparative Examples 2 to 8 and 21 to 26 which do not comprise one of sorbitan fatty acid ester and phospholipid show low cutting resistance, but bad antirust property.

Comparative Examples 9 to 19 which comprise antirust agent other than the combination of sorbitan fatty acid ester and phospholipid show low lubricity or bad antirust property.

Figure 1:
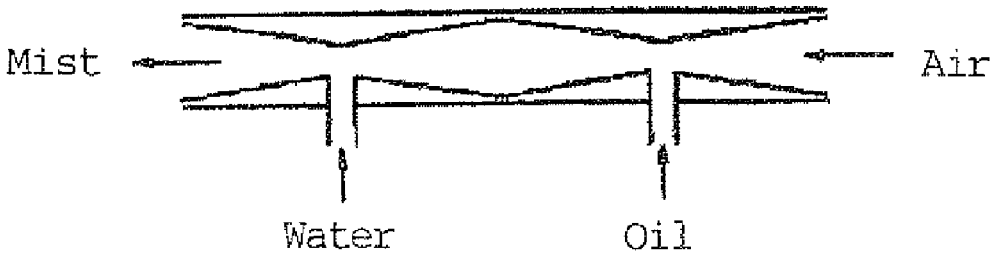
FIG. 1 is a schematic diagram showing one example of apparatus which supply, by air, water drops whose surface is covered with an oil film and which may be used in the method of the present invention.

What is claimed is:

1. A very small amount of oil-feeding type metalworking method, comprising processing a metallic material using a composition comprising (I) a base oil selected from the group consisting of natural fats and oils, derivatives thereof and synthetic ester oils; and (II) an antirust agent consisting of a sorbitan fatty acid ester and a phospholipid, wherein the processing step is cutting or grinding, and wherein the step of processing the metallic material comprises feeding the composition at a rate of 0.5 to 20 mL per one nozzle per hour and feeding water at a rate of 500 to 2000 mL per one nozzle per hour.

2. The metalworking method of claim 1, wherein metallic materials are processed while supplying, by a compressed fluid, water drops covered with the composition.

3. The metalworking method of claim 1, wherein metallic materials are processed while transforming the composition into a form of mist and supplying the mist by a compressed fluid.

4. A metalwork obtained by the metalworking method of claim 1.

5. The metalworking method of claim 1, wherein the sorbitan fatty acid ester comprises at least one selected from the group consisting of sorbitan monooleate, sorbitan sesquioleate, sorbitan dioleate and sorbitan trioleate.

6. The metalworking method of claim 1, wherein the phospholipid comprises at least one selected from the group consisting of egg-yolk lecithin, soybean lecithin and the like.

7. The metalworking method of claim 1, wherein wherein the phospholipid comprises a mixture of phosphatidyl choline, phosphatidyl ethanolamine and phosphatidyl inositol.

8. The metalworking method of claim 1, wherein said composition contains said sorbitan fatty acid ester in an amount of 0.1 to 40% by mass.

9. The metalworking method of claim 1, wherein said composition contains said phospholipid in an amount of 0.1 to 40% by mass.

* * * * *